US010177494B1

(12) United States Patent
Lu et al.

(10) Patent No.: US 10,177,494 B1
(45) Date of Patent: Jan. 8, 2019

(54) PLUGGABLE TRANSCEIVER MODULE

(71) Applicant: Delta Electronics, Inc., Taoyuan (TW)

(72) Inventors: Chen-Mao Lu, Taoyuan (TW); Chieh-Tse Huang, Taoyuan (TW); Yuan-Chen Hsu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 15/826,064

(22) Filed: Nov. 29, 2017

(30) Foreign Application Priority Data

Jun. 26, 2017 (CN) ..... 2017 1 0496386

(51) Int. Cl.
*H01R 13/62* (2006.01)
*H01R 13/629* (2006.01)
*H01R 13/631* (2006.01)

(52) U.S. Cl.
CPC ..... *H01R 13/62938* (2013.01); *H01R 13/631* (2013.01)

(58) Field of Classification Search
CPC ..... H01R 13/631; H01R 13/62938; H01R 13/62933; H01R 13/639; H01R 13/6275; H01R 13/6395
USPC ..... 439/372
See application file for complete search history.

(56) References Cited

U.S. PATENT DOCUMENTS 5,091,991 A * 2/1992 Briggs ..... G02B 6/3825 385/52
6,347,954 B1 * 2/2002 Jones ..... G02B 6/4246 439/138
6,439,918 B1 * 8/2002 Togami ..... G02B 6/4246 439/157
6,533,603 B1 * 3/2003 Togami ..... G02B 6/4246 439/157
6,666,484 B1 * 12/2003 Branch ..... E05C 3/14 292/128
6,890,206 B2 * 5/2005 Distad ..... G02B 6/4261 361/728
6,916,123 B2 * 7/2005 Kruger ..... G02B 6/3897 385/139
7,059,887 B1 * 6/2006 Liu ..... H01R 13/6582 439/372
7,066,746 B1 * 6/2006 Togami ..... G02B 6/4246 385/53
7,186,134 B2 * 3/2007 Togami ..... G02B 6/4246 439/160

(Continued)

*Primary Examiner* — Abdullah A Riyami
*Assistant Examiner* — Vladimir Imas
(74) *Attorney, Agent, or Firm* — Muncy, Geissler, Olds & Lowe, P.C.

(57) ABSTRACT

A pluggable transceiver module is provided. The pluggable transceiver module is adapted to be inserted to a cage. The pluggable transceiver module includes a housing, a cover, a latch, an elastic element, and a bail bar. The latch is sandwiched between the cover and the housing. The latch includes a fastening portion. The elastic element is disposed on the housing and abuts the latch. The bail bar abuts the latch. The bail bar is rotated between a first bar position and a second bar position. When the bail bar is in the first bar position, the fastening portion is affixed to the cage. When the bail bar is rotated from the first bar position to the second bar position, the latch is moved in an oblique direction, and the fastening portion is separated from the cage.

15 Claims, 6 Drawing Sheets

(56) References Cited

U.S. PATENT DOCUMENTS

| | | | | |
|---|---|---|---|---|
| 7,314,384 | B2 * | 1/2008 | Togami | G02B 6/4246 439/160 |
| 7,317,862 | B2 * | 1/2008 | Minota | G02B 6/4292 385/134 |
| 7,374,347 | B1 * | 5/2008 | Oki | G02B 6/4201 385/88 |
| 7,387,538 | B2 * | 6/2008 | Engel | H01R 13/6658 439/620.23 |
| 7,507,111 | B2 * | 3/2009 | Togami | G02B 6/4246 385/88 |
| 7,648,289 | B2 * | 1/2010 | Miyoshi | G02B 6/4201 385/139 |
| 7,699,629 | B2 * | 4/2010 | Sasser | G02B 6/4201 439/108 |
| 8,556,658 | B2 * | 10/2013 | Szczesny | G02B 6/4278 361/704 |
| 9,379,484 | B2 * | 6/2016 | Phillips | H01R 13/62905 |
| 9,954,316 | B2 * | 4/2018 | Song | G02B 6/4202 |
| 2007/0140626 | A1 * | 6/2007 | Chan | G02B 6/3897 385/89 |
| 2010/0112861 | A1 * | 5/2010 | Sasser | H01R 13/6275 439/607.19 |
| 2014/0185988 | A1 * | 7/2014 | Qi | G02B 6/428 385/77 |
| 2015/0341066 | A1 * | 11/2015 | Hsieh | H04B 1/38 361/715 |

* cited by examiner

PLUGGABLE TRANSCEIVER MODULE

CROSS REFERENCE TO RELATED APPLICATIONS

This Application claims priority of China Patent Application No. 201710496386.3, filed on Jun. 26, 2017, the entirety of which is incorporated by reference herein.

BACKGROUND OF THE INVENTION

Field of the Invention

The present invention relates to a pluggable transceiver module, and in particular to a pluggable transceiver module which can be smoothly detached from a cage.

Description of the Related Art

Conventional pluggable transceiver modules are inserted to a cage which is disposed on the circuit board. The cage includes an elastic sheet and a wedging hole formed on the elastic sheet. When the pluggable transceiver module is inserted into the cage, the protrusion of the pluggable transceiver module wedges the wedging hole, the pluggable transceiver module is affixed to the cage, and the pluggable transceiver module is prevented from becoming separated from the cage due to an unexpected strike. In conventional pluggable transceiver modules, the bail bar is rotated around a pivot axis, and the position of the pivot axis is fixed. The bail bar pushes the protrusion to separate the protrusion from the wedging hole. However, the protrusion of the conventional pluggable transceiver module cannot be smoothly detached from the wedging hole of the different cage.

BRIEF SUMMARY OF THE INVENTION

In one embodiment, a pluggable transceiver module is provided. The pluggable transceiver module is adapted to be inserted to a cage. The pluggable transceiver module includes a housing, a cover, a latch, an elastic element and a bail bar. The latch is sandwiched between the cover and the housing. The latch comprises a fastening portion. The elastic element is disposed on the housing and abuts the latch. The bail bar abuts the latch. The bail bar is rotated between a first bar position and a second bar position. When the bail bar is in the first bar position, the fastening portion is affixed to the cage. When the bail bar is rotated from the first bar position to the second bar position, the latch is moved in an oblique direction, and the fastening portion is separated from the cage.

In one embodiment, the latch comprises a connection groove, the bail bar abuts the connection groove, the connection groove has a vertical width and a horizontal width, and the horizontal width is greater than the vertical width.

In one embodiment, the bail bar comprises at least one fulcrum portion and at least one pushing portion, the fulcrum portion abuts the housing, and the pushing portion abuts the connection groove.

In one embodiment, the connection groove comprises a curved surface, and when the bail bar is rotated from the first bar position to the second bar position, the pushing portion slides on the curved surface.

In one embodiment, the pushing portion is located between two fulcrum portions, and the fulcrum portions and the pushing portion form a hat-shaped structure.

In one embodiment, the latch comprises a first section, a second section and a third section, the second section is located between the first and third sections, the connection groove is located on the first section, the fastening portion is located on the third section, and the second section is sandwiched between the cover and the housing.

In one embodiment, when the bail bar is in the first bar position, the latch is in the first latch position, and when the bail bar is in the second bar position, the latch is in the second latch position. An included angle is formed between the first and second latch positions, and the included angle is between 2 and 8 degrees.

In one embodiment, when the bail bar is in the first bar position, the fastening portion is in a first fastening position, and when the bail bar is in the second bar position, the fastening portion is in a second fastening position. A gap is formed between the first and second fastening positions and is between 0.4 mm and 0.8 mm.

In one embodiment, the housing has a bevel, and when the bail bar is in the second bar position, the latch abuts the bevel.

In another embodiment, a pluggable transceiver module is provided. The pluggable transceiver module is adapted to be inserted to a cage. The pluggable transceiver module includes a housing, a cover, a latch, an elastic element and a bail bar. The latch is sandwiched between the cover and the housing. The latch comprises a fastening portion and a connection groove. The connection groove comprises a curved surface. The elastic element is disposed on the housing and abuts the latch. The bail bar abuts the curved surface of the connection groove. The bail bar is rotated between a first bar position and a second bar position. When the bail bar is in the first bar position, the fastening portion is affixed to the cage. When the bail bar is in the second bar position, the bail bar pushes the curved surface of the latch, and the fastening portion is separated from the cage.

In one embodiment, the first section has a guiding surface, and when the bail bar is in the first bar position, and an included angle is formed between the guiding surface and the cover.

In one embodiment, the elastic element is a compression spring, one end of the elastic element is embedded in the housing, and the other end of the elastic element abuts the latch.

Utilizing the pluggable transceiver module of the embodiment of the invention, the pivoting axis of the bail bar is moveable, the latch can be moved in the oblique direction, and the fastening portion sinks into the housing to become separated from the cage. The pluggable transceiver module of the embodiment of the invention can be smoothly detached from the cage of different designs. Compared to the prior art, the pluggable transceiver module of the embodiment of the invention provides a reliable inserted to the cage, and can be smoothly detached from the cage.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is determined by reference to the appended claims.

Figure 1:
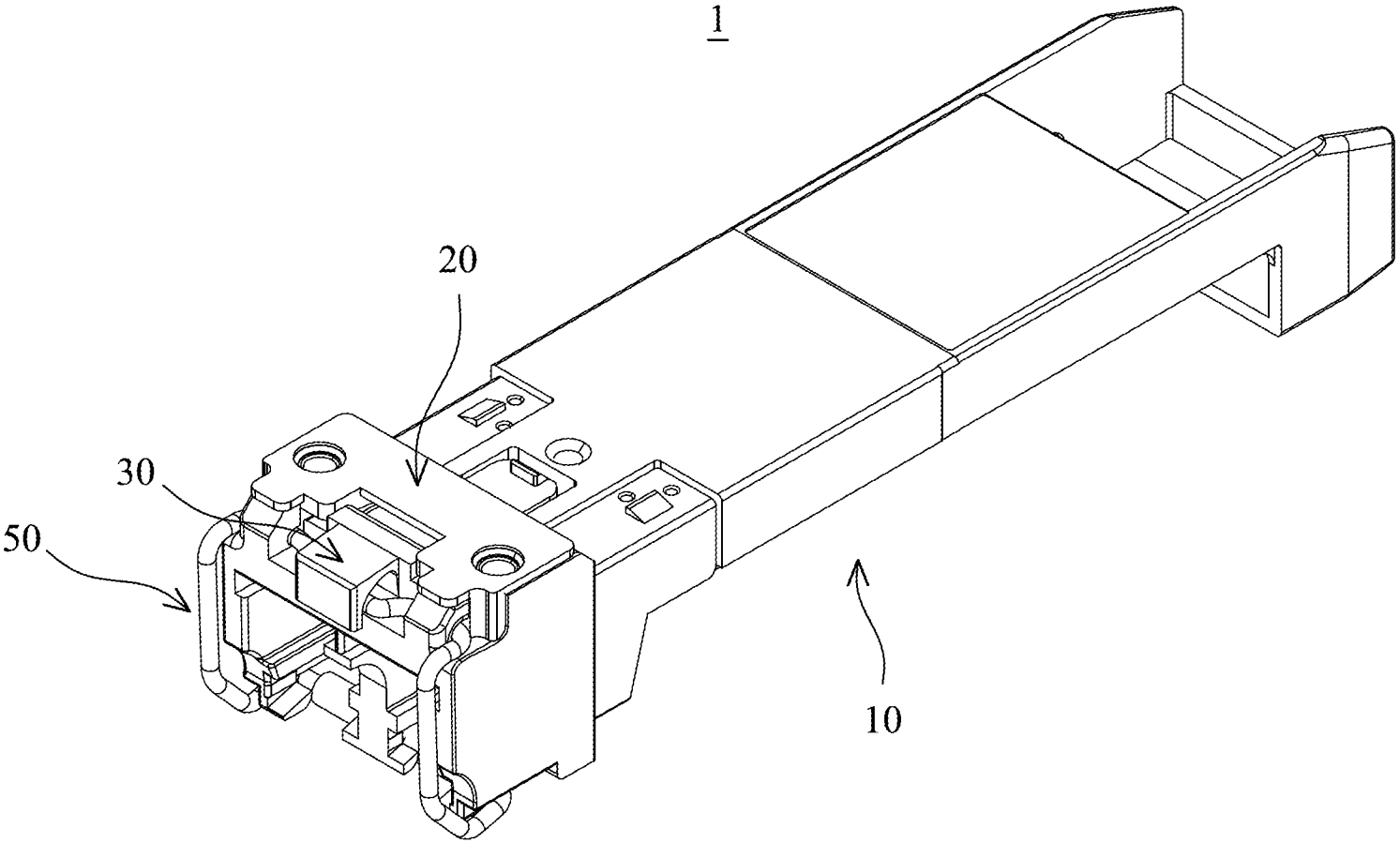
FIG. 1 is a perspective view of a pluggable transceiver module of an embodiment of the invention.
Figure 2:
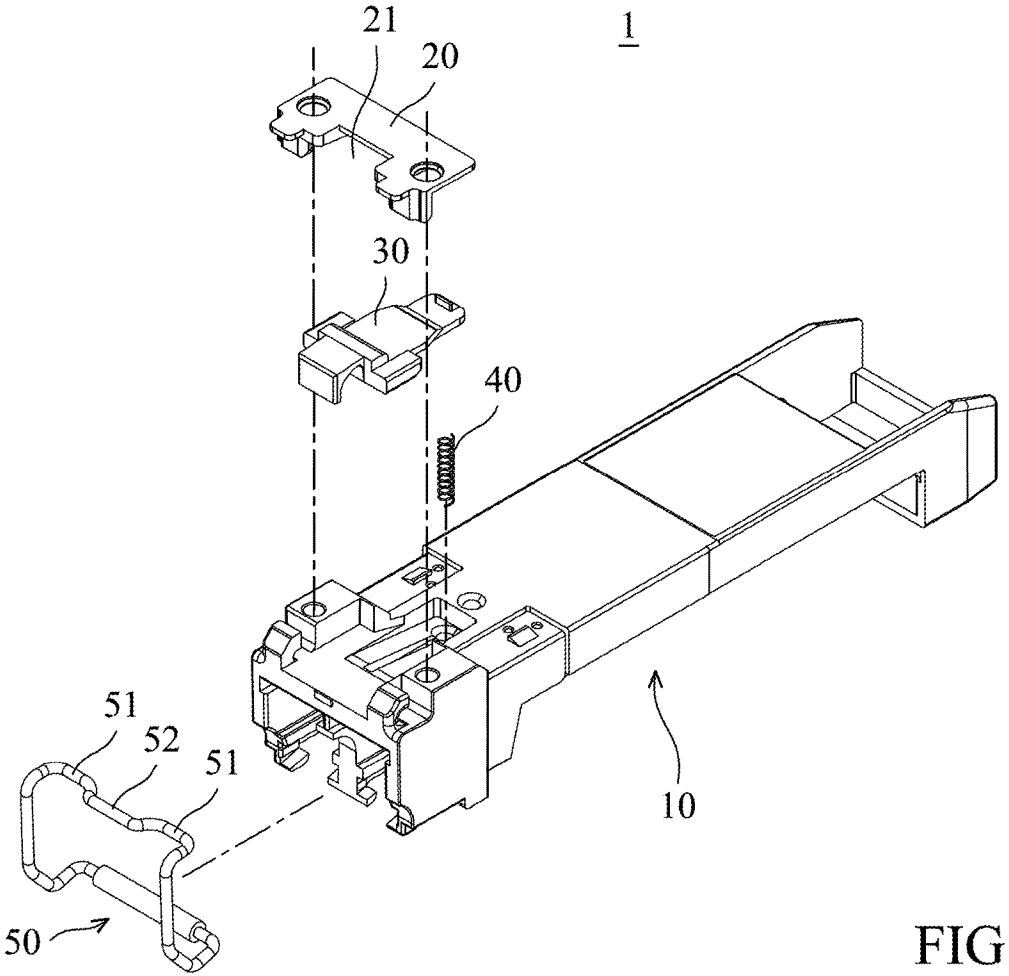
FIG. 2 is an exploded view of the pluggable transceiver module of the embodiment of the invention.

FIG. 1 is a perspective view of a pluggable transceiver module 1 of an embodiment of the invention. FIG. 2 is an exploded view of the pluggable transceiver module 1 of the embodiment of the invention. With reference to FIGS. 1 and 2, the pluggable transceiver module 1 is adapted to be inserted to a cage (not shown) of an electronic device. In one embodiment, the pluggable transceiver module 1 can transmit an optical signal. The pluggable transceiver module 1 includes a housing 10, a cover 20, a latch 30, an elastic element 40 and a bail bar 50. The latch 30 is sandwiched between the cover 20 and the housing 10.

Figure 3:
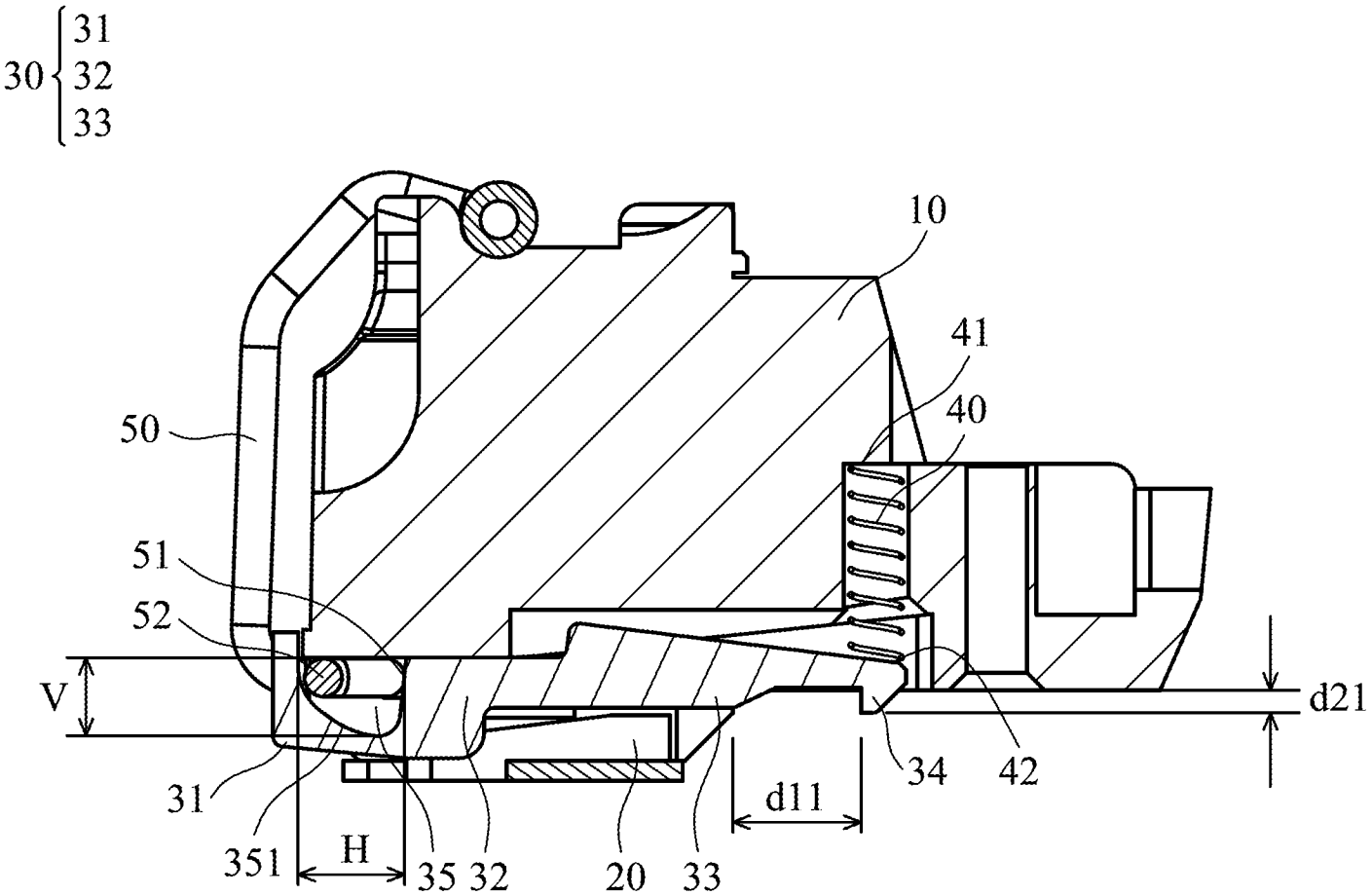
FIG. 3 is a sectional view of the pluggable transceiver module of the embodiment of the invention, wherein a bail bar is in a first bar position.
Figure 4:
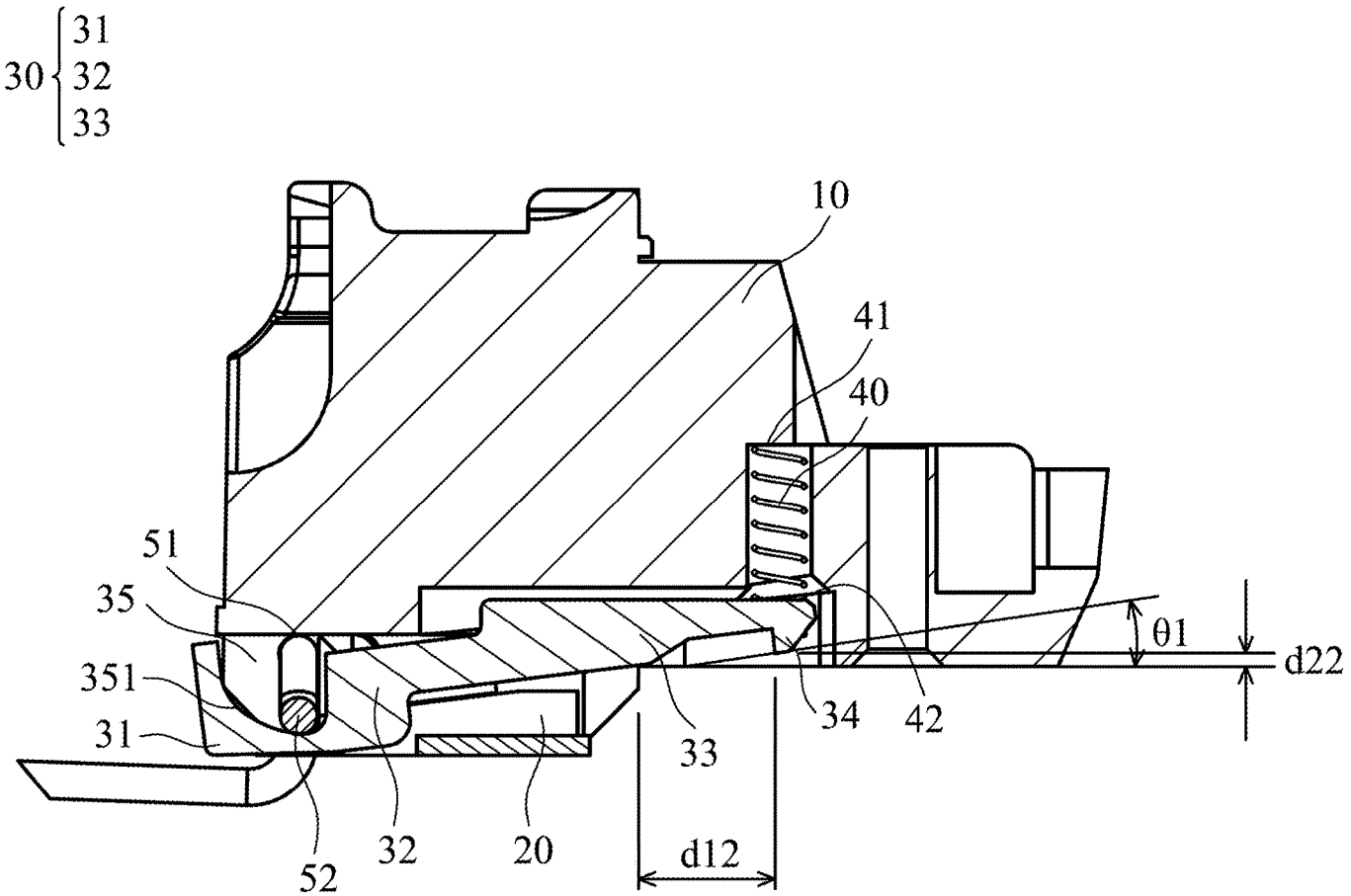
FIG. 4 is a sectional view of the pluggable transceiver module of the embodiment of the invention, wherein the bail bar is in a second bar position.
Figure 5:
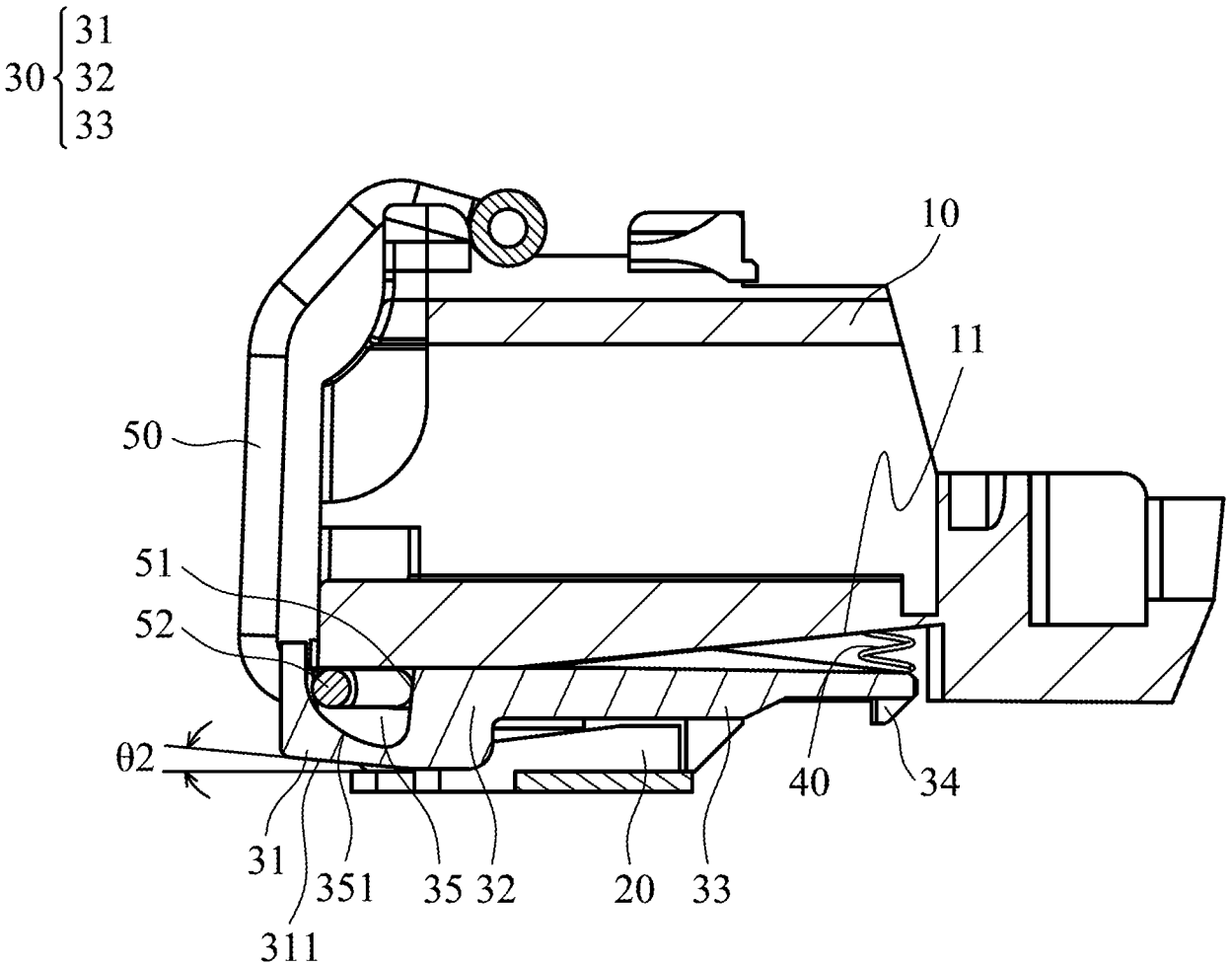
FIG. 5 is a sectional view of the pluggable transceiver module of another embodiment of the invention, wherein the bail bar is in the first bar position.
Figure 6:
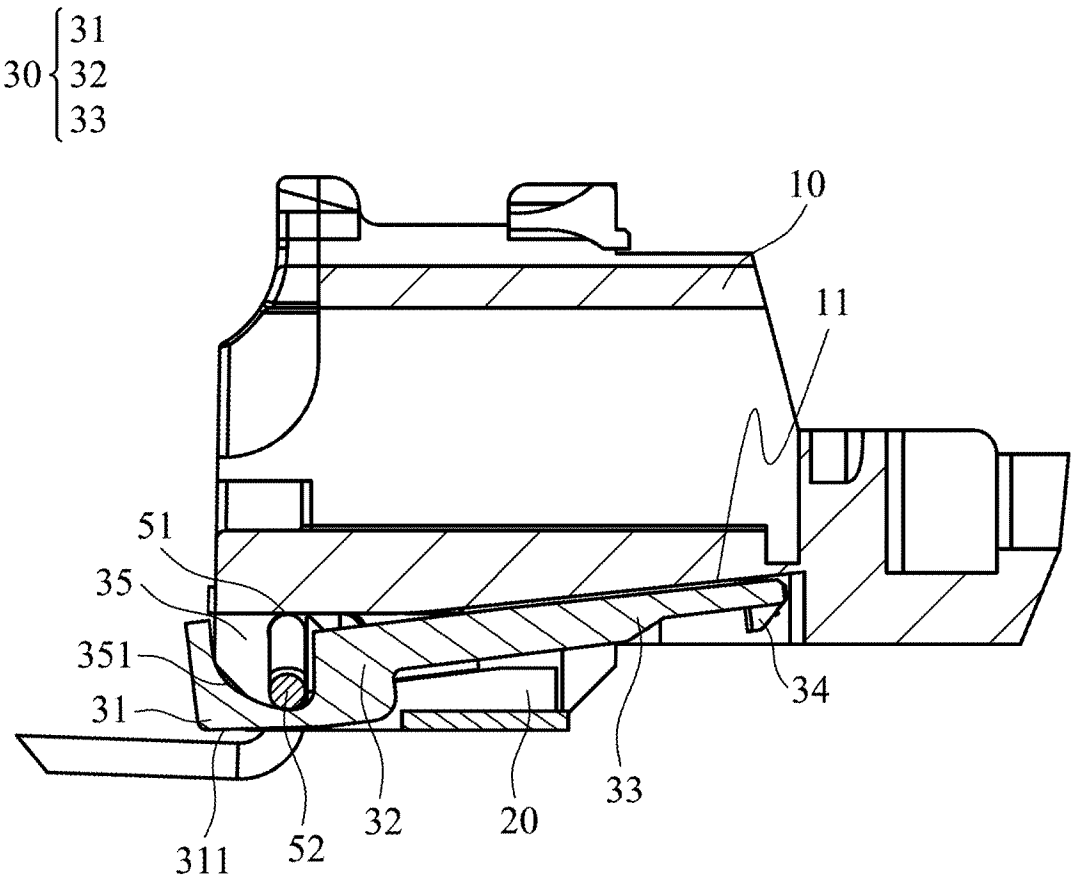
FIG. 6 is a sectional view of the pluggable transceiver module of the embodiment of FIG. 5, wherein the bail bar is in the second bar position.

With reference to FIGS. 3 and 4, the latch 30 comprises a fastening portion 34. The elastic element 40 is disposed on the housing 10 and abutting the latch 30. The bail bar 50 abuts the latch 30. The bail bar 50 is rotated between a first bar position (FIG. 3) and a second bar position (FIG. 4). With reference to FIG. 3, when the bail bar 50 is in the first bar position, the fastening portion 34 is affixed to the cage. With reference to FIGS. 5 and 6, when the bail bar 50 is rotated from the first bar position to the second bar position, the latch 30 is moved in an oblique direction, and the fastening portion 34 is separated from the cage.

In one embodiment, the latch 30 comprises a connection groove 35. The bail bar 50 abuts the connection groove 35. The connection groove 35 has a vertical width (depth) V and a horizontal width H, and the horizontal width H is greater than the vertical width V. In this embodiment, the vertical width V and the horizontal width H are defined as the bail bar 50 in the first bar position. Utilizing the design of the vertical width V and the horizontal width H, the bail bar 50 can push and rotate the latch 30.

With reference to FIG. 2, in one embodiment, the bail bar 50 comprises at least one fulcrum portion 51 and at least one pushing portion 52. With reference to FIGS. 3 and 4, the fulcrum portion 51 abuts the housing 10, and the pushing portion 52 abuts the connection groove 35. In one embodiment, the connection groove 35 comprises a curved surface 351. When the bail bar 50 is rotated from the first bar position to the second bar position, the pushing portion 52 slides on the curved surface 351 to rotate and push and the latch 30. The curved surface 351 enables the pushing portion 52 to rotate and push and the latch 30 smoothly.

With reference to FIG. 2, in one embodiment, the pushing portion 52 is located between two fulcrum portions 51, and the fulcrum portions 51 and the pushing portion 52 form a hat-shaped structure.

With reference to FIGS. 3 and 4, in one embodiment, the latch 30 comprises a first section 31, a second section 32 and a third section 33. The second section 32 is located between the first section 31 and the third section 33. The connection groove 35 is located on the first section 31. The fastening portion 34 is located on the third section 33. The second section 32 is sandwiched between the cover 20 and the housing 10, and is restricted by the cover 20 and the housing 10.

With reference to FIGS. 3 and 4, in one embodiment, when the bail bar 50 is in the first bar position, the latch 30 is in the first latch position (FIG. 3). When the bail bar 50 is in the second bar position, the latch 30 is in the second latch position (FIG. 4). An included angle θ1 is formed between the first and second latch positions, and the included angle θ1 is between 2 and 8 degrees. When the bail bar 50 is in the first bar position, the fastening portion is in a first fastening position (FIG. 3). When the bail bar 50 is in the second bar position, the fastening portion is in a second fastening position (FIG. 4). A gap is formed between the first and second fastening positions, and the gap is between 0.4 mm and 0.8 mm.

In particular, with reference to FIG. 3, in one embodiment, when the bail bar 50 is in the first bar position, a horizontal distance d11 between the fastening portion 34 and the cover 20 is 2.55 mm, and a vertical distance d21 of the fastening portion 34 protruding from the housing 10 is 0.45 mm. With reference to FIG. 4, in one embodiment, when the bail bar 50 is in the second bar position, a horizontal distance d12 between the fastening portion 34 and the cover 20 is 2.76 mm, and a vertical distance d22 of the fastening portion 34 sinking into the housing 10 is 0.26 mm. Therefore, when the bail bar 50 is rotated from the first bar position to the second bar position, the latch 30 is moved in the oblique direction, and the fastening portion 34 is separated from the cage.

In one embodiment, the elastic element 40 is a compression spring. An end 41 of the elastic element 40 is embedded in the housing 10, and the other end 42 of the elastic element 40 abuts the latch 30. The elastic element 40 provides a recovery force for the latch 30 to move the latch 30 from the second latch position to the first latch position. With reference to FIGS. 2, 3 and 4, the housing 10 comprises at least one cylindrical chamber 12, the elastic element 40 is received in the cylindrical chamber 12. The cylindrical chamber 12 is defined by an opening side 121, a bottom side 122 and a contiguous wall 123. The end 41 of the elastic element 40 abuts the bottom side 122. The end 42 of the elastic element 40 protrudes from the opening side 121. An end of a central normal line 124 of the opening side 121 passes through the bottom side 122. The other end of the central normal line 124 of the opening side 121 passes through the fastening portion 34.

With reference to FIGS. 5 and 6, in another embodiment, the housing 10 has a bevel 11. When the bail bar 50 is in the second bar position, the latch 30 abuts the bevel 11. The bevel 11 restricts and guides the movement of the latch 30.

With reference to FIGS. 5 and 6, in one embodiment, the first section 31 has a guiding surface 311. When the bail bar 50 is in the first bar position, and an included angle θ2 is formed between the guiding surface 311 and the cover 20. The guiding surface 311 decreases the interference between the latch 30 and the cover 20, and the latch 30 can therefore be rotated smoothly. With reference to FIG. 2, in one embodiment, the cover 20 has a notch 21. The guiding surface 311 corresponds to the notch 21. The notch 21 further decreases the interference between the latch 30 and the cover 20.

Utilizing the pluggable transceiver module of the embodiment of the invention, the pivoting axis of the bail bar is moveable, the latch can therefore be moved in the oblique direction, and the fastening portion sinks into the housing to become separated from the cage. The pluggable transceiver module of the embodiment of the invention can be smoothly detached from the cage of different designs. Compared to the prior art, the pluggable transceiver module of the embodiment of the invention provides a reliable connection to the cage, and can be smoothly detached from the cage.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A pluggable transceiver module, adapted to be inserted to a cage, comprising:

a housing, comprising at least one cylindrical chamber;

a cover;

a latch, sandwiched between the cover and the housing, wherein the latch comprises a fastening portion;

an elastic element, disposed on the housing and abutting the latch; and a bail bar, abutting the latch, wherein the bail bar is rotated between a first bar position and a second bar position, and when the bail bar is in the first bar position, the fastening portion is affixed to the cage, and when the bail bar is rotated from the first bar position to the second bar position, the latch is moved in an oblique direction, and the fastening portion is separated from the cage;

wherein the elastic element is received in the cylindrical chamber, the cylindrical chamber is defined by an opening side, a bottom side and a contiguous wall, one end of the elastic element abuts the bottom side, the other end of the elastic element protrudes from the opening side, one end of a central normal line of the opening, side passes through the bottom side, and the other end of the central normal line of the opening side passes through the fastening portion.

2. The pluggable transceiver module as claimed in claim 1, wherein the latch comprises a connection groove, the bail bar abuts the connection groove, the connection groove has a vertical width and a horizontal width, and the horizontal width is greater than the vertical width.

3. The pluggable transceiver module as claimed in claim 2, wherein the bail bar comprises at least one fulcrum portion and at least one pushing portion, the fulcrum portion abuts the housing, and the pushing portion abuts the connection groove.

4. The pluggable transceiver module as claimed in claim 3, wherein the connection groove comprises a curved surface, and when the bail bar is rotated from the first bar position to the second bar position, the pushing portion slides on the curved surface.

5. The pluggable transceiver module as claimed in claim 3, wherein the pushing portion is located between two fulcrum portions, and the fulcrum portions and the pushing portion form a hat-shaped structure.

6. The pluggable transceiver module as claimed in claim 3, wherein the latch comprises a first section, a second section and a third section, the second section is located between the first section and the third section, the connection groove is located on the first section, the fastening portion is located on the third section, and the second section is sandwiched between the cover and the housing.

7. The pluggable transceiver module as claimed in claim 3, wherein when the bail bar is in the first bar position, the latch is in the first latch position, and when the bail bar is in the second bar position, the latch is in the second latch position, an included angle is formed between the first latch position and the second latch position, and the included angle is between 2 and 8 degrees.

8. The pluggable transceiver module as claimed in claim 3, wherein when the bail bar is in the first bar position, the fastening portion is in a first fastening position, and when the bail bar is in the second bar position, the fastening portion is in a second fastening position, and a gap is formed between the first fastening position and the second fastening position, wherein the gap is between 0.4 mm and 0.8 mm.

9. The pluggable transceiver module as claimed in claim 1, wherein the housing has a bevel, and when the bail bar is in the second bar position, the latch abuts the bevel.

10. A pluggable transceiver module, adapted to be inserted to a cage, comprising:

a housing, comprising at least one cylindrical chamber;

a cover;

a latch, sandwiched between the cover and the housing, wherein the latch comprises a fastening portion and a connection groove, and the connection groove comprises a curved surface;

an elastic element, disposed on the housing and abutting the latch;

a bail bar, abutting the curved surface of the connection groove, wherein the bail bar is rotated between a first bar position and a second bar position, and when the bail bar is in the first bar position, the fastening portion is affixed to the cage, and when the bail bar is in the second bar position, the bail bar pushes the curved surface of the latch, and the fastening portion is separated from the cage;

wherein the elastic element is received in the cylindrical chamber, the cylindrical chamber is defined by an opening side, a bottom side and a contiguous wall, one end of the elastic element abuts the bottom side, the other end of the elastic element protrudes from the opening side, one end of a central normal line of the opening side passes through the bottom side, and the other end of the central normal line of the opening side passes through the fastening portion.

11. The pluggable transceiver module as claimed in claim 10, wherein the connection groove has a vertical width and a horizontal width, and the horizontal width is greater than the vertical width.

12. The pluggable transceiver module as claimed in claim 10, wherein the bail bar comprises at least one fulcrum portion and at least one pushing portion, the fulcrum portion abuts the housing, and the pushing portion abuts the curved surface of the connection groove.

13. The pluggable transceiver module as claimed in claim 10, wherein the latch comprises a first section, a second section and a third section, the second section is located between the first section and the third section, the connection groove is located on the first section, the fastening portion is located on the third section, and the second section is sandwiched between the cover and the housing.

14. The pluggable transceiver module as claimed in claim 13, wherein the first section has a guiding surface, and when the bail bar is in the first bar position, an included angle is formed between the guiding surface and the cover.

15. The pluggable transceiver module as claimed in claim 10, wherein the housing has a bevel, and when the bail bar is in the second bar position, the latch abuts the bevel.

* * * * *